United States Patent [19]

Tabaru et al.

[11] Patent Number: 4,482,623

[45] Date of Patent: Nov. 13, 1984

[54] PREPARATION METHOD OF MAGNETIC TONER

[75] Inventors: Kazunori Tabaru; Takafumi Aoyama, both of Kumagaya; Toshio Kumakura, Ohmiya, all of Japan

[73] Assignee: Hitachi Metals, Ltd., Tokyo, Japan

[21] Appl. No.: 307,509

[22] Filed: Oct. 1, 1981

Related U.S. Application Data

[63] Continuation of Ser. No. 132,082, Mar. 20, 1980, abandoned, which is a continuation-in-part of Ser. No. 940,647, Sep. 8, 1978, abandoned.

[30] Foreign Application Priority Data

Sep. 9, 1977 [JP] Japan ..... 52-107711
Sep. 22, 1977 [JP] Japan ..... 52-113336

[51] Int. Cl.[3] ..... G03G 9/14
[52] U.S. Cl. ..... 430/137; 324/62; 324/65 R; 324/158 P
[58] Field of Search ..... 324/65 R, 61 P; 430/137

[56] References Cited

U.S. PATENT DOCUMENTS

| | | | |
|---|---|---|---|
| 1,978,440 | 10/1934 | Shepard | 324/65 R |
| 2,870,404 | 1/1959 | Oxley | 324/65 R |
| 2,919,672 | 1/1960 | Benn et al. | 118/688 |
| 3,280,036 | 10/1966 | Howell | 430/110 |
| 3,345,294 | 10/1967 | Cooper | 430/106.6 X |

FOREIGN PATENT DOCUMENTS

| | | | |
|---|---|---|---|
| 1527291 | 10/1978 | United Kingdom | 430/106.6 |

*Primary Examiner*—John D. Welsh
*Attorney, Agent, or Firm*—Finnegan, Henderson, Farabow, Garrett & Dunner

[57] ABSTRACT

The invention involves a method for making one component or single component toner compositions for developing electrophotographic images. A binding component is mixed with magnetic particles, pulverized, then carbon black is mixed with the powder and fixed to the surface of the particles. Compositions having a measured resistivity of $4.3\times10^3$ to $4.3\times10^6$ ohm-cm at a D.C. field of below 20 volts/cm under substantially no-load conditions are selected for use.

9 Claims, 2 Drawing Figures

PREPARATION METHOD OF MAGNETIC TONER

Figure 1A:
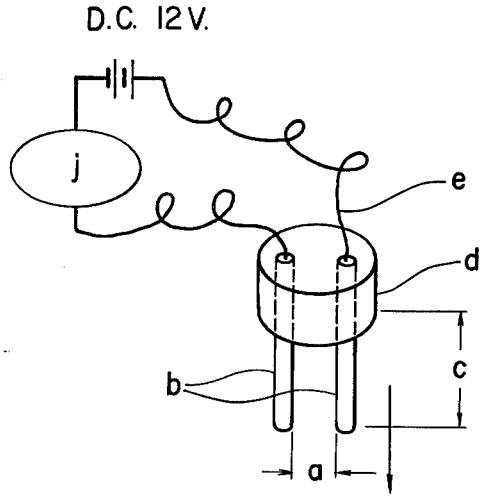

This is a continuation of application Ser. No. 132,082, filed 3/20/80 which is a cont.-in-part of Ser. No. 940,647, filed 9/8/78, both abandoned.

This invention relates to a preparation method of magnetic toner in which a particular resistivity measuring device is used.

Dry developers for developing electrostatic latent images by magnetic brush developing process include so-called "developer mix" and magnetic toners.

Developer mix comprises a mixture of toner particles and ferromagnetic particles. The ferromagnetic carrier particles are resin-coated-iron beads and the toner particles are composed of a mixture of pigment and binder. The carrier particles and the toner particles are triboelectrically charged to the opposite polarity by blending them. The materials of the carrier particles and the toner particles are selected to cause a charge on the toner opposite to the charge of the electrostatic latent image on the image-bearing material. The admixture is stored in a developer vessel in which the toner particles adhere to the surfaces of the carrier particles by the triboelectric charge and is then conveyed on the surface of a magnet roll as the roll rotates. The admixture forms a magnet-brush at a development zone and, when the brush rubs the latent image, the toner particles adhere to the latent image by the-electrostatic attraction force between the charge of the latent image and that of the toner, but the carrier particles remain on the magnetic roll by the magnetic attraction force between the carrier and the roll. After the development the admixture, less the adhered toner, returns to the developer vessel and is supplied new toner.

On the other hand, a single component magnetic toner has been improved to be used in the magnetic brush development and has the advantage that it is not necessary to use the carrier particles or to mix them. Although such a magnetic toner is referred to as "single component" or "one component," the name does not mean that the toner consists of only one component, but the toner comprises mainly one kind of particles composed of fine magnetic particles, organic binder, pigment, carbon black and flow agents. No so-called "carrier" is required.

When electrostatic latent images are to be developed by means of a magnetic toner, a magnetic brush of the magnetic toner is defined on the magnetic roll by the action of magnetic flux lines formed thereon to attract the magnetic brush to the latent images. An electric charge having the polarity opposite to that of latent images is induced at the top of magnetic brush by the electric charge of latent images. The induced charge and the electric charge of latent images attract together and when the latent images are rubbed by the magnetic brush, the magnetic toner attaches to the latent images to make the latent image visible. The developed images are fixed on a latent images bearing member or transferred to another sheet to be fixed thereon.

In contrast to the developer mix in which the toner and the carrier have relatively high resistivity, in the development of latent images by a single component magnetic toner, its electroconductivity or resistivity plays an important role, since induced charge at the development depends on the resistivity.

Consequently, various methods have been proposed for controlling the resistivity to a desired value.

For example, U.S. Pat. No. 3,639,245 to Nelson shows a preparation method of developer powder. A dry-powdered blend of appropriate composition is obtained by melting a resin, stirring in magnetite, allowing the mixture to cool, then grinding and classifying to the appropriate particle range of 1 to 15 microns diameter. This powder is aspirated into a moving gas stream to create an aerosol. The aerosol is directed at about 90° through a stream of hot air heated to 900° to 1,100° F. The resulting powder is now made up of substantially spherical particles. It is then dry blended with conductive powder, such as conductive carbon black, and the mixture is directed at about 90° through a stream of gas heated to 700° to 800° F. The conductive powder is essentially completely embedded on the surface of the resultant toner particle. The toner particle has an insulating core and a conductive surface. This magnetic toner has an electric conductivity ranging from between $10^{-11}$ and $10^{-4}$ mho/cm in a 100 volts/cm D.C. electric field to between $10^{-8}$ and 10 mho/cm in a 10,000 volts/cm D.C. electric field.

Other methods for preparing magnetic toners include that disclosed in British Patent No. 1,406,938 in which a resin and magnetic particles are mixed together by stirring them at a temperature of higher than the melting point of the resin, the cooled mixture is finely divided and the magnetic toner having a certain particle range is collected by screening, which is dispersed in a dispersion of electroconductive carbon black particles in hot water at a temperature from 70° to 80° C. to penetrate carbon black at the vicinity of surface of the magnetic toner and then the carbon-penetrated toner is washed with water, followed by drying. The magnetic toner particles prepared according to this method have the inner electro-insulating core and the highly electroconductive shell portion. However, since such a magnetic toner contains no electroconductive particles as the raw material, the finely divided magnetic toner as such has very high resistivity to facilitate the coagulation. In addition, its aerosol can only with difficulty be prepared in the subsequent spheroidization step and, as the toner cannot be dispersed uniformly into electroconductive particles after the spheroidization of toner, irregularity is induced in the electroconductive layer of the magnetic toner making it difficult to provide magnetic toner having a stabilized composition. In addition, when magnetic toner is dispersed in water, coagulation may occur resulting in the same disadvantages.

In order to overcome such disadvantages, there has been proposed as in Japan Patent Publication No. 47172/1978 a magnetic toner containing electroconductive particles not only on the surface layer but also in the core. It has been confirmed in such a process that less coagulation of the pulverized particles occurs, thereby facilitating the spheroidization during the treatment, and that the process provides toners having stabilized electrical characteristics and high fluidity.

The following measuring procedure as described in U.S. Pat. No. 3,639,245 is usually used for the conductivity measurements.

The sample of toner is placed in a test cell between two brass electrodes of circular cross section, each with a cross section area of about 0.073 $cm^2$. An insulating cylindrical sleeve of polytetra-fluoroethylene surrounds the toner and electrodes such that the sample toner is constrained to the shape of a small pill box. At least one of the electrodes is free to move like a piston in the insulating sleeve to provide a predetermined compression on the sample. The compression is obtained by placing a known weight on the movable electrode, and typically a 100 gram weight is used to give a pressure of 1,370 g/cm$^2$ on the sample. Enough toner is placed into the cell such that the final electrode spacing under the above pressure is about 0.05 to about 0.1 cm, and preferably as close to 0.05 cm as possible. The final spacing is measured carefully using a cathetometer. A voltage is applied in a series circuit arrangement consisting of the toner sample an electrical current meter and the voltage source. The toner conductivity is calculated from the voltage which appears across the sample electrodes and the current which flows through it in the usual manner. The voltage is varied and the resulting conductivity is calculated for various electric fields from about 10 volts/cm to about 1,000 to 4,000 volts/cm.

Measurement

When electrostatic latent images defined on electrostatic recording paper with a magnetic toner and which have low voltage contrast of the images as compared with those on ZnO paper are developed by magnetic brush process, there exist some toners developing more frequently fogging and/or staining and other toners providing well defined images notwithstanding the fact that both have equivalent physical characteristics such as volume resistivity, magnetic characteristics and the like. Namely in the magnetic brush process, the magnetic toner is conveyed on the non-magnetic sleeve by the relative rotation of the sleeve and inner magnet roll to form a magnetic brush on the sleeve and the development is carried out by rubbing the electrostatic latent image by the formed electrostatic brush in which the magnetic toner adheres on the electrostatic latent image by overcoming the magnetic attraction of the magnet roll. Accordingly, the quality of images depends on various characteristics of magnetic toners such as saturated magnetization $4\pi$Is, coercive force IHc, Curie point Tc and the like (these variables depending on the nature and content of magnetic particles), fluidity, electrostatic characteristics and the like, particularly on the electrostatic characteristics which have been found to depend on the electric resistivity of toner. Namely, the adhesion of toner on the electrostatic latent images is more enhanced and the concentration of images becomes more thick with the decreased electric resistivity, but when the electric resistivity is excessively low, the toner may adhere also on nonimage-bearing portions resulting in fogging and the like so that the electric resistivity should be controlled within a proper range. For such reasons, in so-called coated paper copier (CPC) systems in which electrostatic latent images are defined on ZnO paper or electrostatic recording paper and fixed directedly to provide images after the development, it has been generally advisable to use a magnetic toner containing electroconductive particles on the surface and in the core thereof and to develop the latent images by means of a magnet roll equipped with an insulating sleeve. In such a case, there is used ZnO paper prepared by coating a photoconductive layer of zinc oxide dispersed in a resin on electroconductive substrate paper. As the potential difference between the latent image portion and back ground ranges approximately from −400 to −600 volts and the volume resistivity of toner is noticeably correlated with the fogging and the like, images of high quality will be formed by adjusting the volume resistivity within desirable range. However, on the surface of electrostatic recording paper comprising forming a dielectric layer of acrylate resin having volume resistivity of approximately $10^{14}$ Ω.cm on electroconductive substrate paper, as the potential difference between the latent image portion and background portion is less than 100 volts in the absolute value, no such correlation can be observed. This results possibly from the fact that the surface conditions, i.e. the conditions of electroconductive particles stuck firmly on the surface are different even for magnetic toners having the same volume resistivity. The above-mentioned method for measuring the conductivity is considered not to detect such slight difference in the surface conditions.

It is thus an object of this invention to overcome disadvantages of conventional processes and to provide a process for preparing magnetic toners containing electroconductive particles on the surface and in the core thereof and which can provide constantly high quality image by developing electrostatic latent images defined on carriers having a low surface potential.

It is another object of this invention to provide a novel method for measuring volume resistivity which can grasp quantitatively a slight difference of magnetic toners.

FIG. 1 (A) is a schematic view of an apparatus for measuring the resistivity according to this invention; FIG. 1 (B) is a schematic view of a sample vessel for measurement.

According to the present invention, the preparation method comprises the steps of; mixing uniformly magnetic particles and a binding component, pulverizing the mixed material to a certain range of particle diameter, mixing carbon black to the powder mass, fixing the carbon black on the surface of the powder mass, and selecting the powder mass having a resistivity ranging from $4.3\times10^3$ to $4.3\times10^6$ ohm.cm at an electric field below D.C. 20 volts/cm, in which the resistivity is measured under substantially no load by the device that comprises a toner-receiving cavity to be filled by the powder mass and a pair of electric terminals which is inserted down to the powder mass in the cavity and applied by an electric potential below D.C. 20 volts/cm.

The powder mass may be prepared by various processes such as spray drying processes as disclosed in U.S. Pat. No. 3,639,245 pulverizing processes as disclosed in British Patent No. 1,406,938 and Japan Patent Publication No. 47172/1978 and the like.

The measuring apparatus for determining the resistivity of the toner prepared according to the present invention has a very simple structure as shown in FIG. 1.

Figure 1B:
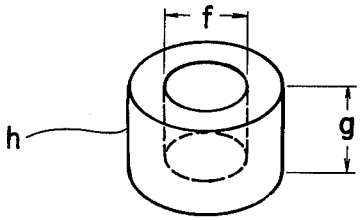

The apparatus comprises a metering device as shown in FIG. 1A, and a vessel for holding the toner sample, the resistance of which is to be measured, as shown in FIG. 1B. The metering device includes a mounting base d made of Teflon* in which are embedded the ends of a pair of measuring terminals b. The measuring terminals b each consists of a Ni-plated copper rod 2.5 mm in diameter. The rods are spaced apart a distance a and extend outwardly from the mounting base d by a distance c. The distance a and c preferably measure 6.0 mm and 25.0 mm, respectively. The metering device also includes a resistance meter j having an internal resistance of 600 Ω connected across the embedded ends of the terminals b by conductors e. A 12.0 V source applies direct current to the metering device through conductors e.

*Trademark of E. I. duPont de Nemours & Co. for polytetrafluoroethylene.

The vessel h of FIG. 1B is a Teflon cylinder having a cylindrical toner-receiving cavity with a diameter f and depth g for holding about 5 g of toner. The distances f and g preferably measure 12.0 mm and 10 mm respectively.

The sample of toner, the resistance of which is to be determined, is carefully poured into the vessel h to fill the toner-receiving cavity and the terminals b are slowly inserted down to the bottom of the vessel.

When the resistivity measured by means of this apparatus is assumed to be Rs, the volume resistivity $\rho s$ can be represented by the following formula using Gauss theorem:

$$\rho_s = R_s \cdot \pi \cdot h/\log \frac{y + \sqrt{y^2 - d^2}}{d} \text{ ohm} \cdot \text{cm} \quad \text{(a)}$$

wherein the variables have the following meanings, respectively:

h: Height of electrode in contact with the toner layer, cm y: ½ of the spacing between electrode centers, cm d: radius of electrode, cm log: log base e

EXAMPLE 1

Figure 2:
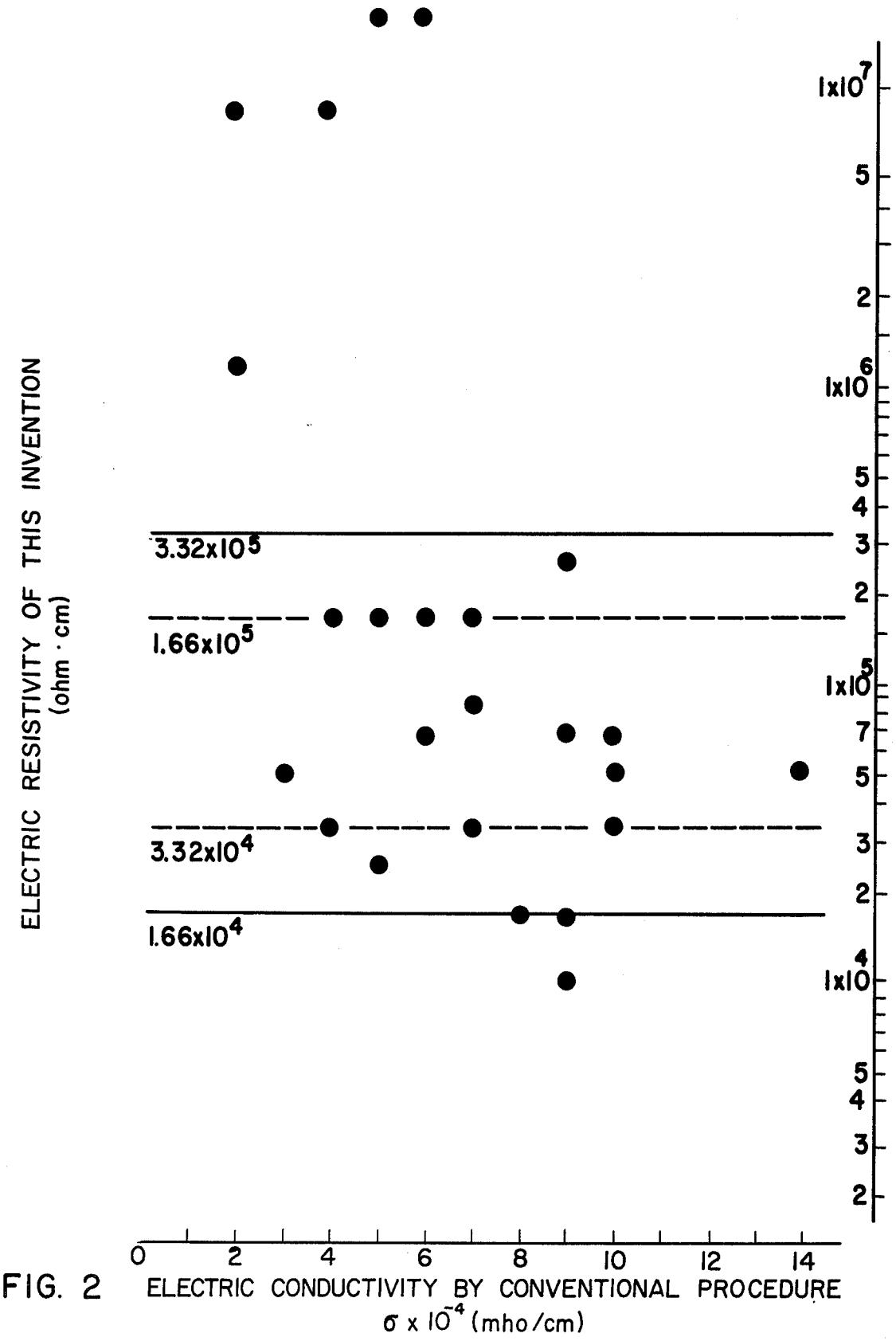

A mixture (10 kg) comprising 45 parts by weight of epoxy resin (Epikote 1004 available from Shell Chemicals), 50 parts by weight of magnetic powder (EPT 500 available from Toda Kogyo Co.) and 5 parts by weight of carbon black (available from Mitsubishi Kasei Co.) was blended at 120° C. in a kneader. After cooled and solidified, the mixture was pulverized in a jet mill. The pulverized powder was then added with carbon black (0.01–3 parts by weight) and mixed uniformly in a mixer and then momentarily heat treated at about 200° C. to stick the carbon black on the surface of finely divided powder. Various toners containing varied amounts of carbon black on the surfaces of powder under varied adhesion conditions were prepared by changing the heat treating temperature. Each of such toners was used to provide each image on the outer periphery of an aluminium shell having an outer diameter of 32 mm by means of a facsimile equipped with a magnet roll having an outer diameter of 29 mm, attached with an insulating sleeve coated with 50 μm-thick polyester film and symmetrically magnetized by 8 poles so that the magnetic flux density on said sleeve was 650 gausses. The development was carried out on electrostatic recording paper running at a rate of 100 mm/sec. by setting the potential of the image portion at −80 V and by controlling the gap between the sleeve and recording paper and the doctor gap each at about 0.4 mm and the developed images were thermally fixed by means of a heater. It has been confirmed from such experiments that there exists a correlation as shown in FIG. 2 between the volume resistivity ($\rho$) as measured by conventional method, volume resistivity ($\rho s$) as measured according to the method of this invention and image quality. Namely it has been observed that toners having the same nonetheless exhibit certain difference in the image quality. This difference is believed to be due to the fact that as the volume resistivity is measured under load by conventional methods so as to bring the carbon black particles on the surface of each toner particles into close contact with each other, substantially no change is introduced in the value of $\rho$ by a change in the adhesion condition of carbon black particles. On the contrary in the measuring process according to this invention, as each toner particle is contacted to each other under substantially no load on the toner particles, the value of $\rho s$ depends significantly on the adhesion condition of carbon black particles on the surface of toner particles so that high quality images can be produced by adjusting the value of $\rho s$. Observation of the surfaces of toners having different values of $\rho s$ shows sparsely attached carbon black particles on the surface of toner having $\rho s$ of $1.66\times10^7$ Ω.cm to expose the inner core material, whereas densely dispersed carbon black particles are attached to the surface of toner having $\rho s$ of $1.66\times10^5$ Ω.cm but some discontinuities can be observed between the carbon black particles. It has been confirmed that carbon black particles cover the whole surface of toner having $\rho s$ of $5.0\times10^4$ Ω.cm without discontinuity. From such observations, it is obvious that the value of $\rho s$ is highly correlated with the surface conditions of toners.

The inventors have found that high quality images can be produced by using toner having a value of $\rho s$ ranging from $1.66\times10^3$ to $1.66\times10^6$ Ω.cm More preferable resistivity range is $1.66\times10^4$ to $3.32\times10^5$ Ω.cm ohm.cm and the best quality of copyed image is obtained by the toner of the resistivity ranging $3.32\times10^4$ to $1.66\times10^5$ Ω.cm.

EXAMPLE 2

Ten kilograms (kgs) of a composition consisting of 45 parts of epoxy resin, 5 parts of carbon black and 50 parts of magnetic powder (all values in part are denoted with the part by weight) are mixed in a continuous kneader at 120° C. After having cooled, a pulverized mass with an average particle diameter of 20 mμ is obtained by a jet mill. To the powder mass is added 3 parts of carbon black and sufficiently mixed with a mixer. Then the mixture is momentarily heat-treated at a temperature of 100° to 260° C. so that carbon black is thermally set on the surface of said fine powder and at the same time the residual amount of carbon attached to the toner surface is adjusted. The characteristics of the obtained toner are shown in Table 1, in which the electric conductivity was determined by the conventional process and also the resistances were determined with the apparatus described above.

TABLE 1

| Sample No. | Temperature of thermal treatment | Electric conductivity (mho/cm) | Resistance KΩ | Blackening of background |
|---|---|---|---|---|
| 1 | 100 | $7\times10^{-4}$ | 1 | slight |
| 2 | 120 | $6\times10^{-4}$ | 10 | nil |
| 3 | 140 | $5\times10^{-4}$ | 30 | nil |
| 4 | 160 | $5\times10^{-4}$ | 40 | nil |
| 5 | 180 | $4\times10^{-4}$ | 80 | nil |
| 6 | 200 | $4\times10^{-4}$ | 200 | nil |
| 7 | 220 | $4\times10^{-4}$ | 1000 | slight |
| 8 | 240 | $4\times10^{-4}$ | 5000 | significant |
| 9 | 260 | $4\times10^{-4}$ | 20000 | " |

As evident from Table 1, the measured values of electric conductivity obtained by the conventional process do not exhibit very significant differences, while the measured resistances show significant differences amounting to $10^4$. When picture images were formed with these toners by a facsimile equipped with an insulating sleeve and a copying machine of the TESI system, the results as shown in the right column of Table 1 were obtained. The copying apparatus employed was of a type which transports the toner by the rotation of a sleeve.

It is evident from Table 1 that, when the resistance exceeds 1 MΩ as determined on the apparatus of FIGS. 1A and 1B, the picture image suffers some blackening of background, and when the resistance exceeds 5 MΩ, the blackening of background increases. When the resistance amounts to 20 MΩ, the blackening grows so remarkably that small letters are not legible. Even when the resistance is less than 1 KΩ, the blackening of background occurs. The reason for this blackening of background is principally mechanical and if the apparatus is equipped with a stationary sleeve and a built-in rotary magnetic roller, the blackening of background does not occur. Furthermore, when the ZnO recording sheet and developing apparatus equipped with a conductive sleeve are used, the blackening of background does not occur so much even when a toner with resistance of about 20 MΩ as shown in Table 1 is used.

In order to illustrate the calculation technique employed herein to obtain volume resistance $(\int s)$ from the measured no-load resistance value ($R_s$) using equation (a), the 10 KΩ $R_s$ value reported at sample #2, Table 1, is converted as follows:

$$\int s = R_s \cdot \pi \cdot h/\log \frac{y + \sqrt{y^2 - d^2}}{d}$$

$$\int s = 1.66 \times 10^4 \ (\Omega \cdot \text{cm})$$

for h=1 cm=depth g y=0.425 cm=½ distance (a+diameter b)

d=0.125 cm=½ diameter b

The comparative electric conductivity values reported at Table 1, third column, were determined by the method disclosed in U.S. Pat. No. 3,639,245 at column 3, lines 53–73.

The resistivities calculated by the equation (a) corresponding to the resistances of 1, 10, 30, 40, 80, 200, 1,000, 5,000 and 20,000 kilo-ohm are 1.66, 16.6, 49.8, 66.4, 133, 332, 1660, 8300, and 33,200 kilo-ohm.cm, respectively. Generally speaking in order to obtain a tidy image, however, it is required that the gap between the recording sheet and the sleeve should be regulated so that the tolerance is about 0.002 mm or less. On the other hand, a toner with a resistivity of less than about $1.66\times10^6$ ohm.cm allows less strict regulation of the gap and a toner with a resistivity within a range of 16.6 to 332 kilo-ohm.cm always forms an image of tidy concentration even when said gap varies about ±0.1 mm.

EXAMPLE 3

Ten kgs of a composition consisting of 35 parts of epoxy resin, 35 parts of polyethylene, 30 parts of magnetic (iron) powder are introduced into cyclohexane and dispersed for 24 hours in a ball mill; the emulsion thus obtained is sprayed and dried with a spray drier of the laboratory type to make spherical toner particles of 22 mμ in average diameter. Then carbon black of 0.1 to 5% on the weight basis of one kg of said toner is added and attached mechanically to the surface of the toner at 50° C. by a mixer to adjust the resistivity (αs) of the toner. Subsequently, when a picture image is formed as in Example 1, a tidy picture image is obtained with a toner of 1.66 to $1.66\times10^3$ resistivity. On the other hand, the conductivity measurement by the conventional measurement process was 1 to $2\times10^4$ mho/cm, thus providing no significant difference.

As mentioned above, especially when a image should be formed on an electrostatic recording sheet, the ρs-value of the toner is very important in order to obtain a tidy image without blackening of blackground. This tendency is the same even when the type of magnetic particles and adhesive resin, and the process for preparing the toner are different. When the measured value by the apparatus as shown in FIG. 1 is within a range of 1 to 1,000 KΩ, that is, $1.66\times10^3$ to $1.66\times10^6$ ohm.cm, particularly within a range of 10 to 500 KΩ, that is, $1.66\times10^4$ to $1.66\times10^5$ ohm.cm, a remarkably tidy and sharp image is formed.

Furthermore, the toner of the present invention provides a very sharp image not only when electrostatic recording sheets are used but also when recording sheets of ZnO type are used, and it is easily developable by a development machine with a sleeve whether conductive or insulative. Thus the toner of the present invention has a great many applications.

It is preferable to mechanically fix carbon black particles on the surface of the developer powder. The binding component or resin of magnetic developer powder, which is ordinarily an organic compound of high molecular weight, are degraded by heat treatment even at a low temperature as 100° C.–150° C. which can cause a chemical reaction such as polymerization or decomposition. The deterioration of the resin of pressure-fixable developing powder causes off-set phenomena. The deterioration of the resin of heat-fusible developing powder results in extremely poor fixing properties.

Since a mechanical surface treatment at room temperature causes a comparatively small amount of mechanochemical reaction of resin, the deterioration of the resin of developer powder is extremely little compared to a heat treatment and can be ignored. The advantage of the developer powder according to this invention is based on the above-mentioned reason.

As mentioned above, the fluidity of developer powder is necessary for obtaining a clear duplication. The developer powder according to this invention is provided with an excellent fluidity, so in the development using the developer powder according to this invention, lack of uniformity of the developer powder applied to a latent image, which conventionally occured by trapping of developer powder on a doctor-blade, would not occur. The following examples will elucidate in more detail the present invention.

EXAMPLE 4

Ten kgs of a composition consisting of 45 parts of epoxy resin, 5 parts of carbon black and 50 parts of magnetic powder or magnetite (all values in part are denoted with the part by weight) are mixed in a continuous kneader at 120° C. After having cooled, a pulverized mass with an average particle diameter of 20 mμ is obtained by a jet mill. To the powder mass is added 3 parts of carbon black and sufficiently mixed. Then the mixture is momentarily heat-treated at 100° to 260° C. so that carbon black is thermally set on the surface of said fine powder. Then to the powder mass is added 0.01–1.5 parts of carbon black, mixed in a high speed mixer and the carbon black particles are mechanically fixed on the surface of the powder, and at the same time the residual amount of carbon black attached to the toner surface is adjusted by a jet.

The characteristics of the obtained toner are shown in Table 2, in which the electric conductivities were determined by the conventional measuring process and resistances were determined with the apparatus shown in FIG. 1. The resistances may be correlated to the resistivities by the equation (a). The rest angle which expresses the fluidity of the powder is also shown.

TABLE 2

| Sample No. | Carbon content fixed mechanically | Electric conductivity (mho/cm) | Resistance (KΩ) | Rest angle (deg) | Blackening of background |
|---|---|---|---|---|---|
| 1 | 0 | $4 \times 10^{-4}$ | 20000 | 37 | significant |
| 2 | 0.01 | $4 \times 10^{-4}$ | 5000 | 36 | slight |
| 3 | 0.05 | $4 \times 10^{-4}$ | 2000 | 35 | nil |
| 4 | 0.1 | $4 \times 10^{-4}$ | 500 | 34 | nil |
| 5 | 0.2 | $4 \times 10^{-4}$ | 100 | 33 | nil |
| 6 | 0.4 | $4 \times 10^{-4}$ | 60 | 32 | nil |
| 7 | 0.6 | $4 \times 10^{-4}$ | 30 | 31 | nil |
| 8 | 0.8 | $5 \times 10^{-4}$ | 10 | 30 | slight |
| 9 | 1.0 | $5 \times 10^{-4}$ | 6 | 30 | slight |
| 10 | 1.2 | $5 \times 10^{-4}$ | 4 | 29 | slight |
| 11 | 1.4 | $5 \times 10^{-4}$ | 2 | 28 | slight |

As is evident from Table 2, the measured values obtained by the conventional process do not present very significant differences, while measured values obtained by the measuring process of the present invention show significant differences amounting to around $\sim 10^4$. When the amount of carbon black fixed mechanically on the surface of toner particles increases, the rest angle becomes smaller, and the fluidity becomes larger.

For example, when the rest angle become larger than 37 degrees, the blocking of toner particles in a toner vessel occurs and it becomes impossible to develop a latent image. As shown in Table 2, a latent image can be developed to get a clear duplication using the toner particles with 0.01 to 1.5 parts of carbon black, preferably with 0.05 to 0.8 parts of carbon black.

EXAMPLE 5

A composition consisting of 35 parts of epoxy resin, 35 parts of polystyrene, 30 parts of magnetic particles (iron powder) are introduced into cyclohexane and dispersed for 24 hours in a ball mill, of which the emulsion thus obtained is sprayed and dried with a spray dryer of the laboratory type to make spherical toner particles of 22 μm average diameter. Then carbon black of 0.01 to 2 parts on the weight basis of 0.5 kg of said toner is added and attached mechanically as described in Example 3. Subsequently, when a picture image is formed as in example 3, a tidy picture image is obtained with a toner of $9.96 \times 10^3$ to $1.66 \times 10^6$ohm.cm resistivity, measured by the apparatus in FIG. 1 and calculated by the equation (a), and of 30 to 34 degrees in the rest angle.

The optimum amount of carbon black fixed mechanically on the surface of the toner particles is different according to the latent image bearing plate or paper. The preferred amount of carbon black for ZnO coated paper is 0.01 to 1.2 parts, 0.1 to 1.5 parts for electrostatic recording paper, and 0.01 to 0.4 parts for ZnO coated master paper or Se coated drum in a plain paper copier (PPC) system.

What is claimed is:

1. In the method of making single component magnetic toners of the type composed of fine magnetic particles, carbon black, and an organic binder, the method including the steps of uniformly mixing the magnetic particles and the binding component, pulverizing the mixed material to a preselected range of particle diameters to form a toner powder mass, mixing the carbon black with the powder mass, thermally fixing the carbon black on the surfaces of the particles comprising the powder mass, and grading the powder mass according to its electric resistivity, the improvement comprising measuring the resistivity under substantially no-load conditions, said measuring step being carried out in a measuring device having a toner-receiving cavity and further including the sub-steps of (a) pouring the powder mass into the cavity, (b) inserting a pair of spaced-apart electrodes into the poured powder mass, (c) applying an electric potential below about 20 volts D.C./cm of separation across the spaced-apart electrodes, and (d) adjusting the measured resistivity to determine the volume resistivity of the powder mass, and wherein the grading step includes selecting a powder mass having a resistivity ranging from about $1.66 \times 10^3$ to about $1.66 \times 10^6$ ohm.cm as determined by said measuring step.

2. The improved method as set forth in claim 1, wherein the grading step further includes selecting a powder mass having a resistivity ranging from about $1.66 \times 10^4$ to about $3.32 \times 10^5$ ohm.cm.

3. The improved method as set forth in claim 1, wherein in the fixing step the carbon black is thermally fixed on the surfaces of the individual particles of the powder mass by heating the mixture to a temperature between about 100° to 260° C.

4. The improved method as set forth in claim 1, wherein the carbon black content fixed on the surfaces of the individual particles of the powder mass is about 0.01 to about 1.5 weight % of the powder mass.

5. The improved method as set forth in claim 1, wherein, in the step of mixing carbon black with the powder mass, the carbon black is fixed mechanically on the surfaces of the individual particles of the powder mass.

6. The improved method as in claim 2, wherein the grading step further includes selecting a powder mass having a resistivity ranging from about $3.32 \times 10^4$ to about $1.66 \times 10^5$ ohm.cm.

7. In a method of making magnetic toners of controlled resistivity, for use in copiers having electrostatic latent images defined on carriers having a low surface potential, the method including the steps of uniformly mixing magnetic particles and a binding component, pulverizing the mixed material to a preselected range of particle diameters to form a toner powder mass, mixing carbon black with the powder mass, thermally fixing the carbon black on the surfaces of the particles comprising the powder mass, and grading the powder mass according to its electric resistivity, the improvement comprising the steps of:

measuring the resistivity under substantially no-load conditions, said measuring step being carried out in a measuring device having a toner-receiving cavity and further including the sub-steps of (a) pouring the powder mass into the cavity to a depth of 10 mm, (b) inserting a pair of 2.5 mm diameter electrodes spaced-apart 6.0 mm at the surfaces into the poured powder mass, (c) applying an electric potential below about 20 volts D.C./cm of separation across the spaced-apart electrodes and (d) recording the resistivity of the powder mass, and selecting the powder mass having a resistivity ranging from about 1 KΩ to 1000 KΩ at an electic field below D.C. 20 volts/cm for preventing depositions on the non-image portions of said low surface potential carriers.

8. The improved method as in claim 7 wherein the selecting step includes selecting the powder mass having a resistivity ranging from about 10 KΩ to 200 KΩ.

9. The improved method as in claim 7 wherein the grading step includes the step of adjusting the measured resistivity to determine the volume resistivity of the powder mass.

* * * * *